US007188555B2

(12) United States Patent
Beauchamp

(10) Patent No.: US 7,188,555 B2
(45) Date of Patent: Mar. 13, 2007

(54) MULTI-BIT DRIVER

(75) Inventor: Fern Beauchamp, St. Catharines (CA)

(73) Assignee: Invent Smart Inc., St. Catharines (CA)

( * ) Notice: Subject to any disclaimer, the term of this patent is extended or adjusted under 35 U.S.C. 154(b) by 0 days.

(21) Appl. No.: 09/902,718

(22) Filed: Jul. 12, 2001

(65) Prior Publication Data

US 2002/0007705 A1 Jan. 24, 2002

Related U.S. Application Data

(60) Provisional application No. 60/219,446, filed on Jul. 20, 2000.

(51) Int. Cl.
*B25G 1/08* (2006.01)

(52) U.S. Cl. ..... 81/439; 81/177.4; 81/490

(58) Field of Classification Search ..... 81/177.4, 81/490, 439, 436

See application file for complete search history.

(56) References Cited

U.S. PATENT DOCUMENTS

| | | | | |
|---|---|---|---|---|
| 2,629,413 | A | 2/1953 | Stettler | |
| 2,635,661 | A | 4/1953 | Egan | |
| 2,749,953 | A | 6/1956 | Rundle | |
| 2,765,013 | A | 10/1956 | Pedersen | |
| 3,006,395 | A | 10/1961 | Dye | |
| 3,750,729 | A * | 8/1973 | Lemieux | 81/439 |
| 4,372,362 | A | 2/1983 | Ahn | |
| 4,463,788 | A | 8/1984 | Corona et al. | |
| 4,533,271 | A | 8/1985 | Sansevero | |
| 4,552,043 | A | 11/1985 | Corona et al. | |
| 4,552,044 | A | 11/1985 | Corona et al. | |
| 4,716,795 | A | 1/1988 | Corona et al. | |
| 4,716,796 | A | 1/1988 | Corona et al. | |
| 4,762,036 | A * | 8/1988 | Orlitzky et al. | 81/177.4 |
| 4,916,988 | A | 4/1990 | Robertson | |
| 5,024,566 | A | 6/1991 | Ippolito et al. | |
| 5,026,190 | A | 6/1991 | Longarzo | |
| 5,228,363 | A | 7/1993 | Corona et al. | |
| 5,325,745 | A * | 7/1994 | Koehler | 81/439 |
| 5,337,637 | A * | 8/1994 | Bih-Lien | 81/439 |
| 5,526,721 | A | 6/1996 | Waisvisz | |
| 5,673,600 | A | 10/1997 | Yanagi | |
| 5,899,618 | A | 5/1999 | Kobayashi | |
| 6,134,995 | A | 10/2000 | Shiao | |
| 6,205,893 | B1 * | 3/2001 | Sato | 81/490 |
| 6,332,384 | B1 * | 12/2001 | Cluthe | 81/490 |
| 6,378,407 | B1 | 4/2002 | Purkapile | |

(Continued)

FOREIGN PATENT DOCUMENTS

| | | |
|---|---|---|
| CA | 1301493 | 5/1992 |
| CA | 2298714 | 8/2001 |

*Primary Examiner*—Jacob K. Ackun, Jr.

(57) ABSTRACT

A multi-bit driver comprises a longitudinally oriented housing including a bit chuck at one end; a plurality of tool bits nested within said housing in a retracted position; and bit assemblies including tool bits and being operable to extend said tool bit from said refracted position to said extended position by a single longitudinal motion for selectively extending tool bits to an extended position and retracting said tool bits to said retracted position, such that in the extended position, said tool bits project from said bit chuck and are substantially longitudinally aligned with said housing.

14 Claims, 12 Drawing Sheets

U.S. PATENT DOCUMENTS 6,502,484 B2 1/2003 Pao-Hsi
6,510,768 B2 1/2003 Fruhm
6,601,483 B2 8/2003 Wannop
6,701,814 B2 3/2004 Purkapile
2002/0152850 A1 10/2002 Wannop
2003/0084758 A1 5/2003 Chiang

* cited by examiner

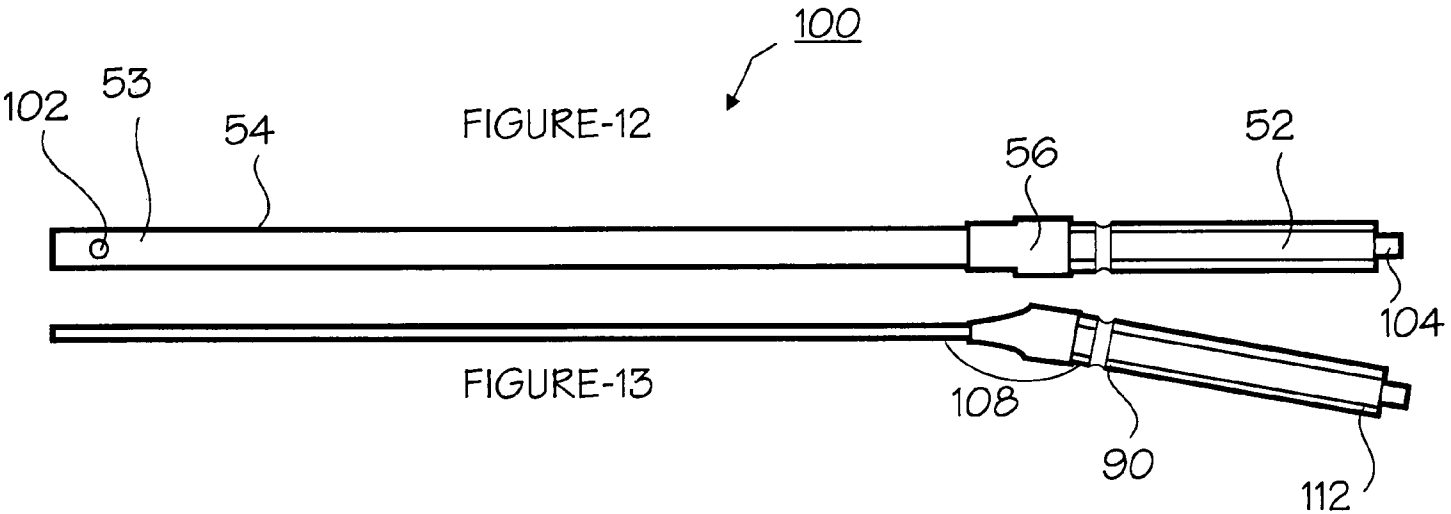
FIGURE-12
FIGURE-13
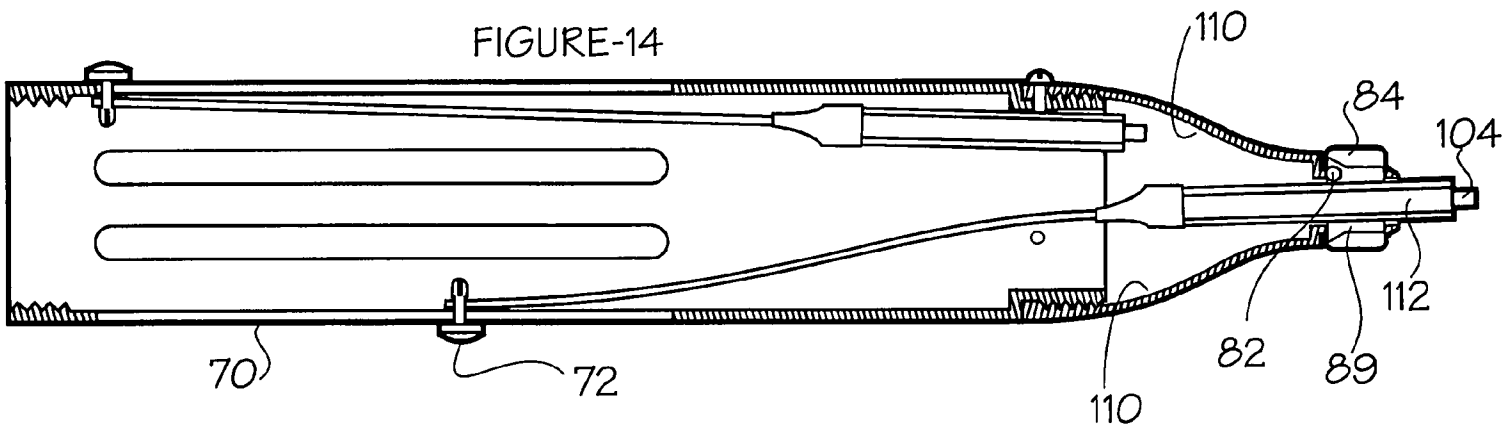
FIGURE-14

MULTI-BIT DRIVER

This application claims the benefit of Provisional Application No. 60/219,446 filed Jul. 20, 2000.

FIELD OF THE INVENTION

This invention relates to hand held multi-bit screwdrivers having tool bits retained within a housing in a retracted position, and being movable to an extended position for subsequent use.

BACKGROUND OF THE INVENTION

Various types of multi-bit drivers are presently available in the market that provide a plurality of readily available tool bits in a single easy-to-use multi-bit driver which minimizes the time for bringing a tool bit into and out of operation and also decreases the time for selecting one tool bit from another.

One such multi-bit driver is disclosed in U.S. Pat. No. 3,750,729 issued Aug. 7, 1973 to Lemieux and entitled Multiple Driver Tool. This multi-bit driver has a chamber for holding a plurality of drivers (also commonly known as tool-bits) for screws and the like. For each driver, a guided slide is retained in a co-operating guide track channel for movement between a retracted position and an extended in-use position, and is connected to the driver by an elongate connector. In the extended in-use position, the driver extends through a passage at the forward end of the chamber and projects forwardly therefrom.

An annular wall that defines the chamber tapers inwardly to the inner end of the passage. When any one of the drivers is moved forwardly along the chamber towards its extended position, its outer end is guided into the inner end of the passage by the tapered annular wall. This is the specific means that is provided for guiding each of the drivers into the passage, as specifically stated at column 2, starting at line 57, and is the only guiding means taught. There is no other means taught that guides the selected tool bit into the passage when the tool bit is moved to its extended position.

In order for the driver to be guided into the passageway, the connector that connects the slide to the driver must be sufficiently flexible to permit the driver to follow along the tapered annular wall of the housing to the passage. The flexible connector is in the shape of a tube and is formed from strip of material tightly wound in the shape of a helix, with no space between adjacent coils. The material is either metal or suitable plastic, thus providing a comparatively rigid but bendable connector, as specifically stated at column 2, lines 45 and 46. A helically coiled compression spring (see column 3, line 38), with spaces between adjacent coils, surrounds each connector in its retracted position, to bias the connector and the attached driver to the retracted position, yet still allow the connector to be equally flexible in all directions, as it is moved to its extended position.

It can be seen that the connector with the spring around it has an effective cross-section that is radially consistent. In other words, the effective shape and diameter of the connector is the same in any radial direction away from the axial center. Accordingly, the connector bends consistently in any angular direction. No provision has been made for causing or allowing the connector to bend more in one angular direction than in another angular direction, or to resist bending in more in one angular direction than in another angular direction.

Depending on the orientation of the entire device, this angular deflection in any direction may cause the driver to try to enter the passage from a skewed direction when the driver is moved towards its extended position, which is highly undesirable, since the driver might tend to jam against the annular wall. This potential problem is heightened by the fact that the working end of the driver may have a shape (such as a wide slot screwdriver bit, or other Philips or Robertson screwdriver bits) that readily catches on the entrance to the passageway at the termination of the tapered annular wall, or catches on the annular wall, as the driver is being moved to its extended position. Further, the overall shape of the connector changes on an ongoing basis due to the fact that the adjacent coils of the connector contact each other. When the connector flexes and returns to its rest position, the adjacent coils bind slightly, thus precluding the connector from returning to the exact same shape each time. The changed shape causes the driver to be skewed, and thus not be aligned with the passage.

Another problem with the multi-bit driver disclosed in the Lemieux patent is that in order to preclude rotation of the driver with respect to the housing, it uses round tool bits having two radial keys disposed on the back end of each tool bit. Each key engages a co-operating slot formed in the housing and extending radially outwardly from the passage. With such an arrangement, the two keys must fit closely into the respective slots, or else the driver will be loose during use, which is unacceptable. Accordingly, the slots must be only marginally wider than the respective key, thus making insertion of the key into the slot an operation requiring precise alignment. Although the drivers are constrained such that each of the keys generally aligns with the respective slot when the drivers are in their retracted positions, the keys may readily be displaced out of proper alignment by uncontrolled deflection during movement to the extended position. This is caused, at least in part, by the overall flexibility of the connector that connects the driver to the slide.

This particular problem is even greater in multi bit drivers that employ hexagonally shanked drivers. Such hexagonally shanked tool bits must register and align almost perfectly with the co-operating hexagonal bit receiving channel in the bit chuck, otherwise the selected tool bit will not slide through the bit chuck into its extended position. Only very minimal deflection or twisting of these tool bits as they are urged from their retracted position to their extended position can be tolerated, as the edges of the hexagonal flutes will catch on the inner wall of the bit chuck, adjacent the back end of the hexagonal bit receiving channel. Since the tool bit shank is hexagonal, the bit extension must have qualities that minimize twisting to ensure proper tool bit insertion into the channel. The bit extension needs to be flexible in the radial direction and rigid in the transverse direction, ensuring the driver is inserted into the channel the same way each and every time, thereby greatly reducing the chance of jamming.

Another disadvantage of the constant cross-section connectors as disclosed in the Lemieux patent, is that since they are equally flexible in all radial directions, there is the definite possibility of lateral flexing of any extended drivers. Accordingly, a driver that is partially extended could readily tangle with the other drivers.

U.S. Pat. No. 5,325,745 issued Jul. 5, 1994, to Koehler, discloses a Screwdriver, wherein extensions from the bits (referred to as drivers in the Lemieux patent and commonly referred to as tool bits) are not of a constant cross-section, in order to provide increased flexibility in a direction aligned radially with its central longitudinal axis. The screwdriver as taught has a plurality of bit assemblies retained within the hollow interior of a housing. Each bit assembly has a bit with a rearwardly disposed hexagonal end. A leaf spring is attached to the central portion of the bit and extends laterally outwardly to terminate in a thumb piece disposed externally to the housing. In use, the thumb piece is manually slid forwardly until it abuts against the leading end of its slot. It is then pushed radially inwardly, in a transverse direction to the original movement, so as to move the hexagonal end of the bit immediately in front of a cooperating hexagonal recess. In order to accomplish this radially inwardly directed movement, the leaf spring must be quite flexible in that direction, and not stiff. Accordingly, it could not be used in the multi-bit driver as specifically taught by Lemieux, which requires a stiff yet still bendable connector. It can be seen from the usage description that engaging a bit requires numerous cumbersome steps. In addition the back of the bit must be perfectly aligned with the hexagonal recess before fitting the bit shank into the recess is possible.

There is a need for a multi-bit driver that is easily used, allows for very quick selection of tool bits, that prevents the loss of tool bits through misuse, that provides for a rugged dependable design, that prevents jamming on extension or retraction of the selected tool bit, and minimizes the chance of the tool bits interfering one with another by means of controlling the lateral stiffness of the tool bit extensions.

SUMMARY OF THE INVENTION

In accordance with one aspect of the present invention there is disclosed a novel multi-bit driver comprising longitudinal housing including a bit chuck having a tool bit receiving channel, and plurality of actuator channels, and defining a longitudinal axis. A plurality of tool bits are nested within the housing in a retracted position. An actuating means is for selectively extending the tool bits from the retracted position to an extended position whereat the selected tool bit projects from the tool bit receiving channel, and retracting the selected tool bit from the extended position to the retracted position. The bit chuck precludes the tool bit from rotating axially when in the extended position. A locking means is for locking the tool bit in the extended position. Each actuating means is adapted to be easily deflected in a radial direction with respect to the longitudinal axis and resists deflection in a transverse direction relative thereto, to operably align the selected tool bit with the tool bit receiving channel as the tool bit is urged into the extended position.

In accordance with another aspect of the present invention there is disclosed a novel multi-bit driver comprises a longitudinal housing including a bit chuck having a tool bit receiving channel, and a plurality of actuator channels, and defining a longitudinal axis. A plurality of bit assemblies each including a tool bit are incorporated in the housing. An actuating means is for selectively extending tool bits from the retracted position to an extended position whereat the selected tool bit projects from the a tool bit receiving channel, and retracting the selected tool bit from the extended position to the retracted position. The bit chuck precludes the tool bit from rotating axially when in the extended position. A locking means is for locking the tool bit in the extended position. Each bit assembly is adapted to be easily deflected in a radial direction with respect to the longitudinal axis and resists deflection in a transverse direction relative thereto, to operably align the selected tool bit with the tool bit receiving channel as the tool bit is urged into the extended position.

The present invention multi-bit driver comprises:

(a) a longitudinally oriented housing including a bit chuck at one end;

(b) a plurality of tool bits nested within said housing in a retracted position; and (c) an actuating means for selectively extending tool bits to an extended position and retracting said tool bits to said retracted position, such that in the extended position, said tool bits project from said bit chuck and are substantially longitudinally aligned with said housing.

Preferably wherein said actuating means including said tool bits and being operable to extend said tool bit from said retracted position to said extended position by a single longitudinal motion of said actuating means.

Preferably wherein said longitudinal motion is effected using a single finger or thumb pressure.

Preferably wherein said actuating means connected to said tool bits being operable to retract said tool bits from said extended position to said retracted position by a single longitudinal motion of said actuating means.

Preferably wherein said longitudinal motion is effected using a single finger or thumb pressure.

Preferably wherein said actuating means operates to extend said tool bit by longitudinal motion in one direction and retract said tool bit by longitudinal motion in the opposite direction.

Preferably wherein said longitudinal motion is effected using a single finger or thumb pressure.

Preferably wherein said actuator means further includes at least one bit assemblies having a flexible bit extension connected to each of said tool bits, said bit extensions for operatively urging said tool bits between said extended and retracted position and for aligning said tool bits with said bit chuck.

Preferably wherein said actuating means further includes at least one longitudinally aligned actuator channels defined in said housing corresponding to each bit assembly for guiding said bit assemblies slidably along a longitudinal direction.

Preferably further including a fastening means slidably connecting said bit assemblies to said actuator channels such that said bit assembly is guided slidably along said actuator channel.

Preferably wherein said fastening means comprises an actuator knob partially projecting externally of said housing for the application of finger pressure thereto, said actuator knob also for connecting a fastener end of said bit assembly to said actuator knob for operatively urging said bit assembly slidably along said actuator channel.

Preferably wherein said housing including a cone proximate said bit chuck having an interior guide surface for slidably guiding tool bits into alignment with said bit chuck as tool bits are urged into said extended position.

Preferably further including a guide means for maintaining said bit assemblies separate and nested proximate the inner surface of said housing, and for guiding said bit assemblies as they are urged between the extended and retracted position.

Preferably wherein said guide means includes permanent magnets mounted in the barrel of said housing for magnetically attracting said tool bits and for maintaining said bit assemblies separate and nested proximate the inner surface of said housing, and for guiding said bit assemblies as they are urged between the extended and retracted position.

Preferably further including a locking means for locking said tool bit in said extended position.

Preferably wherein said bit assemblies include a bit extension connected to said tool bit with a connector.

Preferably wherein said bit extension being flexible in the radial direction and stiffer in the lateral direction.

BRIEF DESCRIPTION OF THE DRAWINGS

The invention will now be described by way of example only with references to the following drawings in which:

FIG. 12 is a top plan view of the bit assembly.

FIG. 13 is a side plan view of the bit assembly.

FIG. 14 is a partial cut away view of the multi-bit driver showing the relationship of the bit assemblies of the barrel.

DETAILED DESCRIPTION OF THE PREFERRED EMBODIMENT

Definition: Tool bits come in a variety of lengths and are normally made of hardened steel and have an hexagonal profile with a variety of driver heads such as Robertson, Phillips, Torx and Allen etc.

Figure 1:
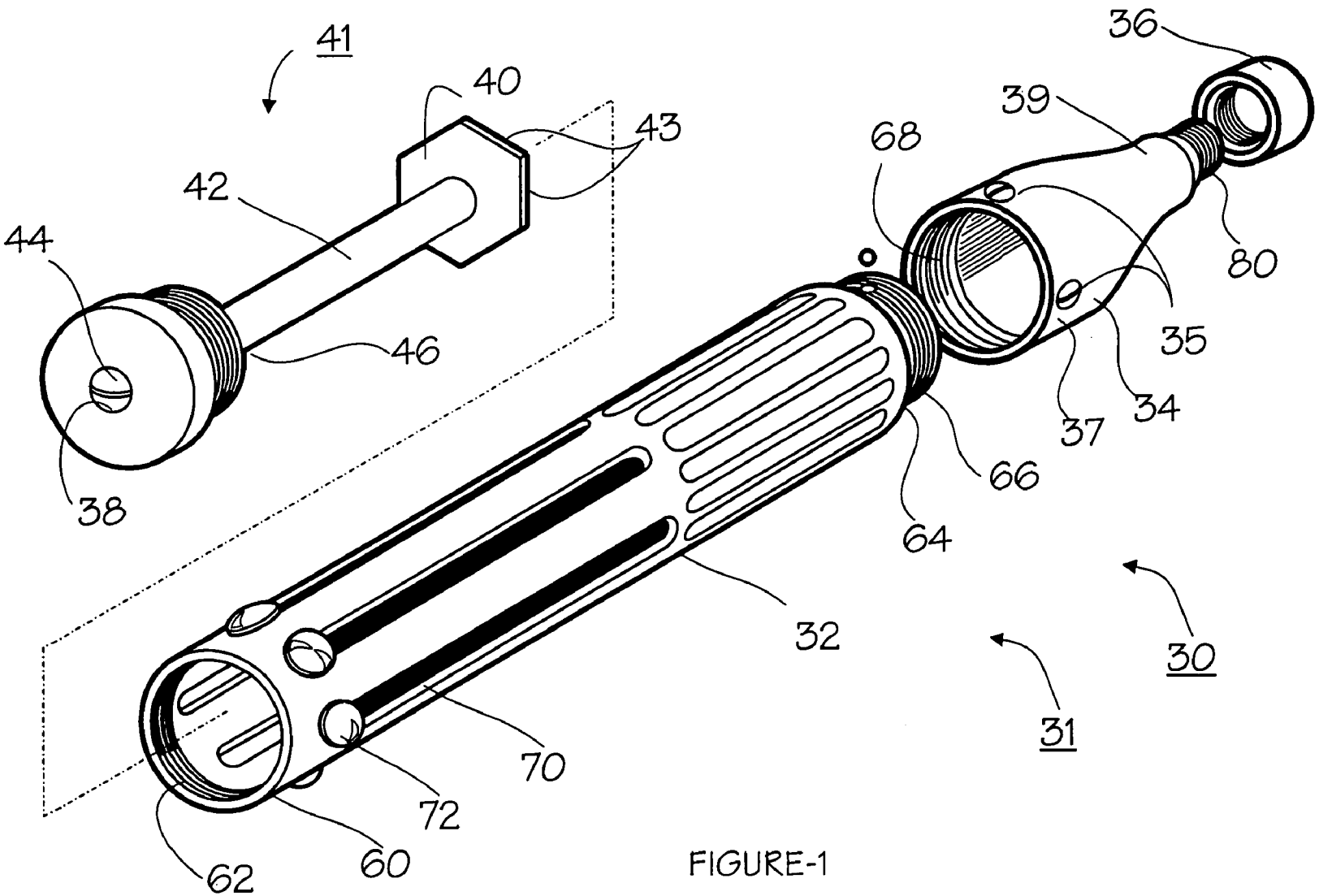
FIG. 1 is a partial exploded perspective schematic view of the driver
Figure 2:
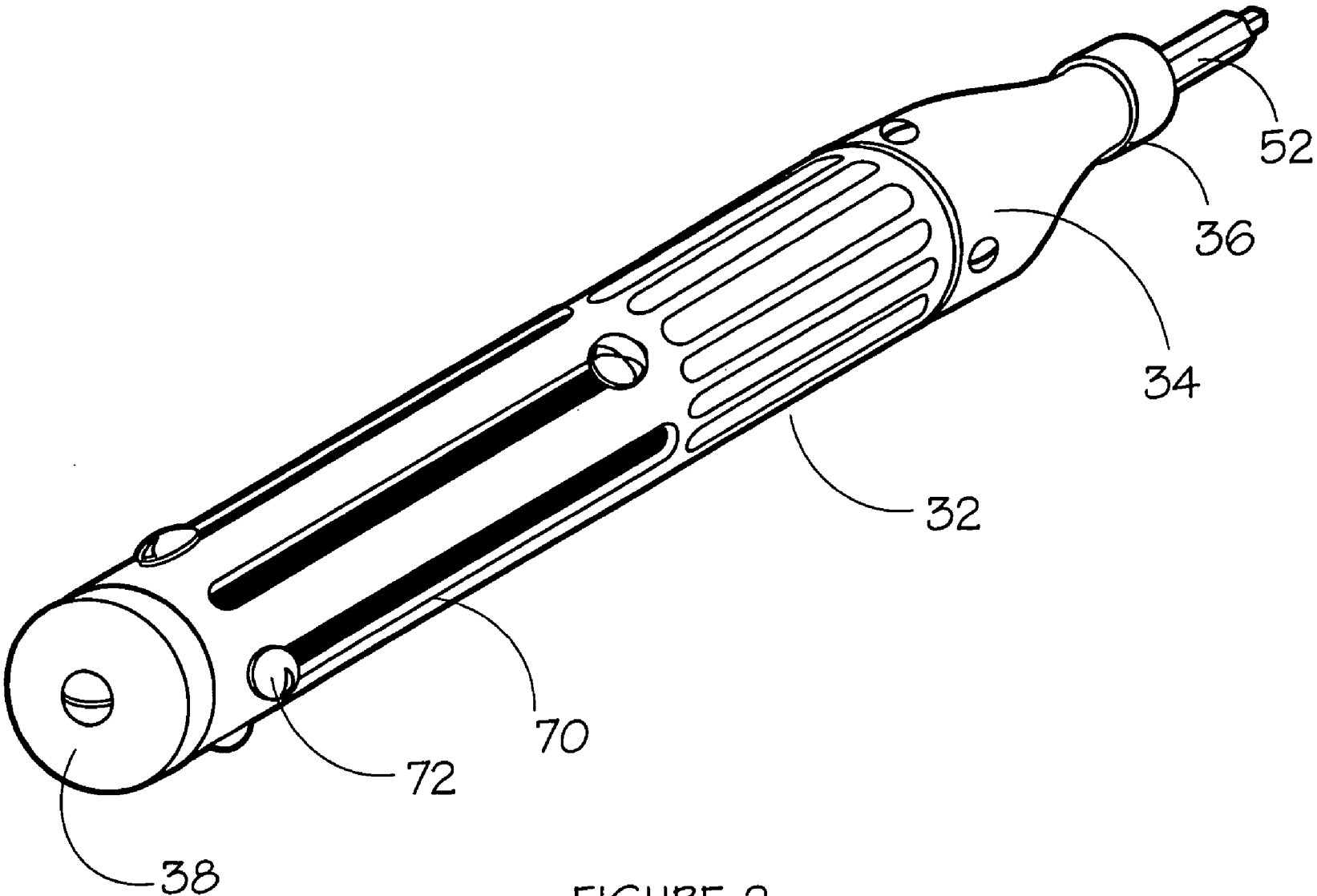
FIG. 2 is an assembled perspective schematic view of the multi-bit driver.
Figure 3:
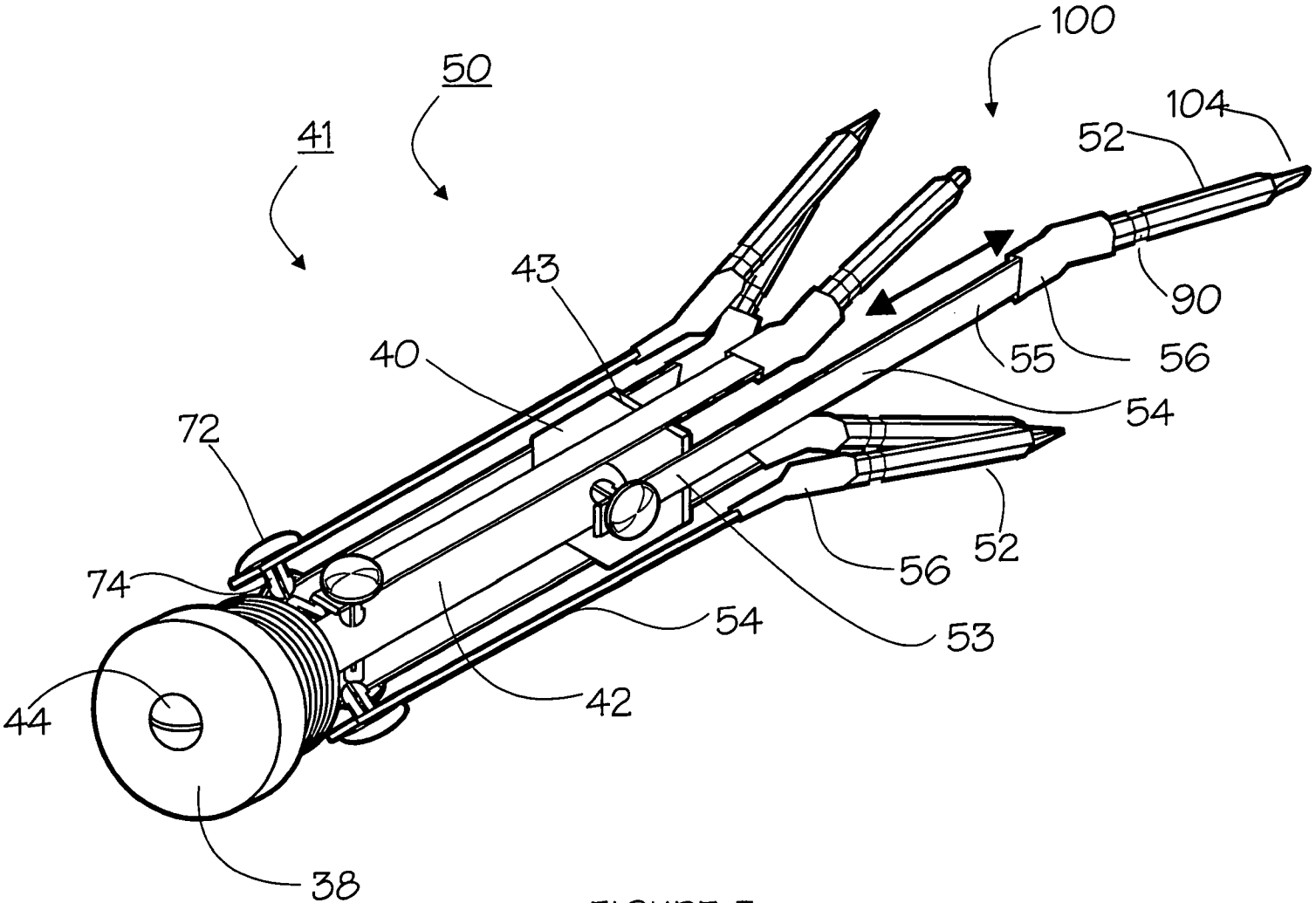
FIG. 3 is a perspective schematic view of the bit cartridge.
Figure 4:
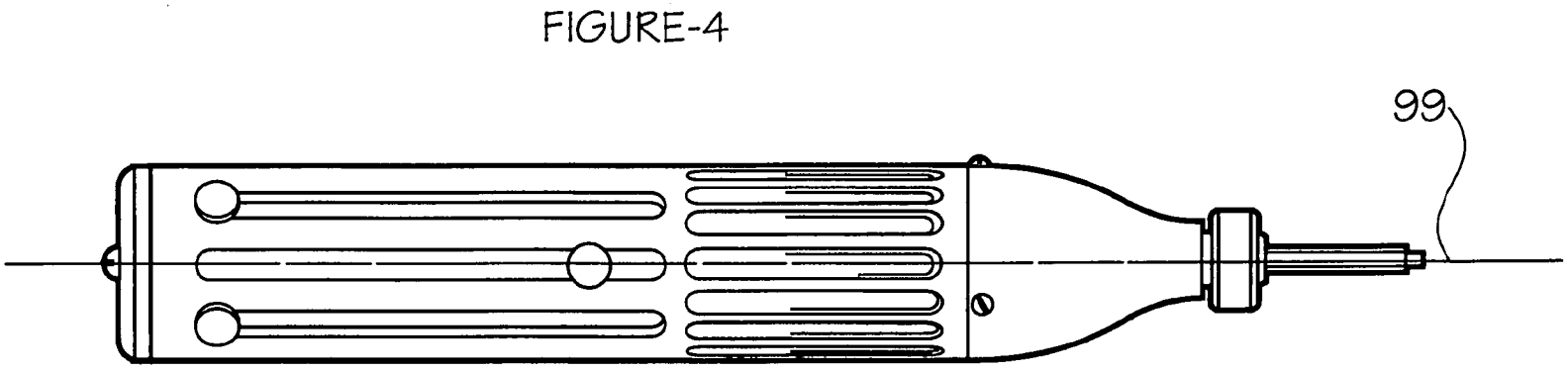
FIG. 4 is a top plan view of the multi-bit driver.
Figure 6:
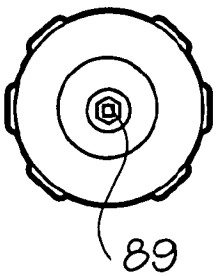
FIG. 6 is a second end view of the multi-bit driver shown in FIG. 4.
Figure 5:
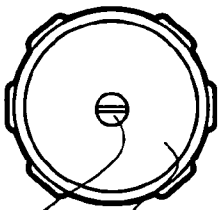
FIG. 5 is a first end view of the multi-bit driver shown in FIG. 4.
Figure 7:
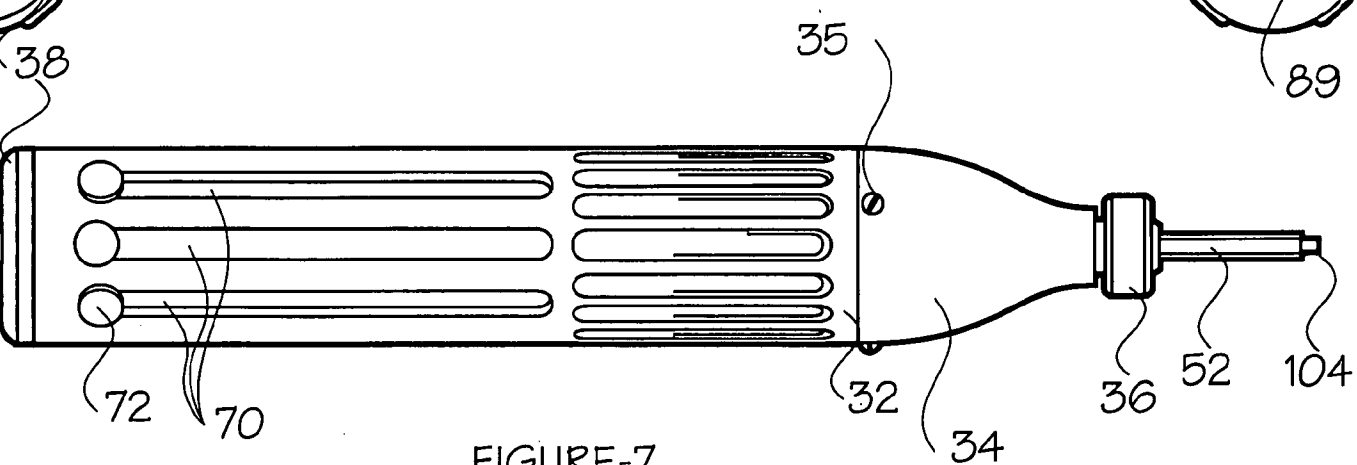
FIG. 7 is a bottom plan view of the multi-bit screw driver.

The present invention, a multi-bit driver shown generally as 30 includes the following major components which are depicted in FIGS. 1, 2 and 3. The multi-bit driver 30 includes a longitudinal housing 31 defining a longitudinal axis, a cone 34, a collar 36, and a bit cartridge 50 which includes bit guide 41.

Referring now to FIG. 1, which is partial exploded view of multi-bit driver 30, housing 31 includes barrel 32, actuator channel 70, actuator knobs 72, external threads 66, proximate cone end 64 and threads 62, proximate cap end 60.

Housing 31 further includes the cone 34 as an integral part thereof, with the cone 34 having an externally threaded bit chuck 80 at the chuck end 39. The bit chuck 80 has a hexagonal tool bit receiving channel 89, that receives the co-operatingly shaped hexagonal profile tool bits 52. In this manner, the bit chuck 80 precludes the tool bit 54 from rotating axially when in the extended position. Of course, other shapes of tool bit shanks, could be used, including other multi-faceted shapes, round shanks with keys, and so on. An internally threaded collar 36 threadably engages the bit chuck 80. Internal threads 68 proximate barrel end 37 of the bit chuck 80 engage the co-operating external threads 66 on the housing 31 to thereby retain the cone 34 on the barrel 32. Additionally, locking screws 35 are used. The cone 34, also has an interior guide surface 110 disposed between the retracted tool bits 52 and the bit chuck 80, for slidably guiding the tool bits 52 into alignment with the bit chuck 80 when the tool bits 52 are urged into their extended position.

Bit cartridge 50 shown best in FIG. 3 is made up of two major assemblies, namely bit guide 41 which is shown on FIG. 1 and bit assembly 100.

As best viewed in FIGS. 3, 12 and 13, bit assembly 100 includes bit extension 54, with a fastener aperture 102, proximate fastener end 53 and a tool bit 52 connected to bit extension 54 with connector 56. Tool bit 54 is of the type commercially available in the market place and normally would have a locking groove 90 at one end and a driver head 104 at the other end. As depicted in FIGS. 1, 2 and 3, bit cartridge 50 contains six bit assemblies 100 in this particular arrangement. Fewer or more bit assemblies could be utilized simply by scaling up or down the geometry shown in FIGS. 1, 2 and 3. In practise, the size of multi-bit driver 30 will limit the upper limit of bit assemblies 100 that are practically feasible in using in multi-bit driver 30 since there are many different driver heads 104 currently on the market, a minimum of four bit assembly 100 seems to be the lower practical limit for the number of driver heads. Having said that, however, there is no reason why multi-bit driver 30 could not be made with only one or two bit assemblies 100 and upwards of 12, 16 or 20 bit assemblies 100 except for practicalities of size and function of multi-bit driver 30.

Bit guide 41 is best seen in FIG. 1, includes guide support 42 having connected at one end thereof guide 40 and at the other end, end cap 38 having a screw 44 connecting guide support 42 to cap end 38, wherein cap end 38 has cap threads 46 which are threadably received by threads 62 of cap end 60 of barrel 38. Bit assemblies 100 are connected to barrel 32 via actuator knob 72 having integrally connected therewith a knob fastener portion 74 for slidably fastening bit assembly 100 to barrel 32 of the housing 31 through an actuator channel 70. The actuator knob 72 is thereby also a fastening means.

Guide 40 has in this case six guide faces 43 for receiving slidably thereon bit extension 54 each of which rest on a guide face 43 and can be slidably moved along guide face 43, as actuator knob 72 is urged along actuator channel 70.

There is also an actuating means for selectively extending the tool bits from the retracted position to an extended position. In the extended position, as can be best seen in FIGS. 2, 4, 7, and 10, the selected tool bit projects from the tool bit receiving channel 89. The actuating means is also for retracting the selected tool bit from the extended position to the retracted position, whereat the tool bit is fully nested within the housing.

Each actuating means includes a bit extension 54 operably connected at one end to one of the tool bits 52. At the other end, each bit extension 54 is operably slidably connected to the housing 31, by the actuator knobs 72, as described above. In this manner, each bit assembly is guided slidably along an actuator channel 70. Each of the actuating means, and more specifically the bit extensions 54, are adapted to be easily deflected in a radial direction with respect to the longitudinal axis and resists deflection in a transverse direction relative thereto. In this manner, the selected tool bit 52 is operably aligned with the tool bit receiving channel 89, as the tool bit 52 is urged to the extended position. Preferably, the actuating means are flexible, but they may also be adapted to be easily deflected in other suitable manners. As can be seen in the figures, the bit extension 54 is flat, and has a planar profile with a width greater than its thickness. Preferably, the bit extension has a thickness to width ratio of at least 1:1.5, and even more preferably a thickness to width ratio of at least 1:3.0. By having the actuating means adapted to be easily deflected in a radial direction with respect to the longitudinal axis and resistive deflection in a transverse direction relative thereto, the actuating means operably aligns the selected tool bit 52 with the tool bit receiving channel 89 as the tool bit 52 urged into the extended position.

Assembly

Firstly bit assembly 100 is assembled together by fastening bit extension 54 to tool bit 52 using a connector 56. As shown in the attached diagram connector 56 is a shrink wrap type material that is commercially available which upon applying heat shrinks onto the portion which is within the shrink wrap itself. This is only one method of connecting tool bit 52 to bit extension 54. Many other methods known in the art can be equally successfully used. Particularly is contemplated molding bit extension 54 which is normally made of a flexible plastic material directly into one end of tool bit 52 which is normally made of a hardened steel material.

In order for the multi-bit driver 30 to function properly, the bit assemblies 100 (bit extension 54, connector 56, and bit 52) must have certain properties. The bit extension 54 or the bit connector 56, or both together, must act as a hinge, that is, one or both must be flexible in the radial direction and stiffer relative thereto in the transverse direction in accordance with the classic hinge design, in order to deliver the tool bit 52 in the proper angular and rotational orientation to the bit chuck 80. The radial flexibility can be at single point or node or at an infinite series of points or nodes across the bit extension 54 or the bit connector 56 (in other words, as a hinge, or a pivot, or a flexural or living hinge structure). The bit extension 54 as a living hinge or a flexural hinge itself must be made of a resiliently flexible material which allows for elastic bending of bit extension portion 54 along its entire length. In this regard, many plastics are suitable including polypropylene, Nylon™, Teflon™, Vinyl™ and like plastic materials. The bit extension 54 can be made as a separate piece joined to the tool bit 52 by the bit connector 56 or it can be overmolded onto the tool bit 52, such that the bit extension 54 and the bit connector 56 comprise one and the same flexural unit and function as a living hinge. The bit extension 54 alone or in conjunction with the bit connector 56, as a hinge (from a single node or pivot to an infinite series of points or nodes across a flexural hinge), has memory properties which ensure that the tool bit 52 is always delivered to the bit chuck 80 in similar angular and rotational orientation to ensure it is aligned properly and is slidably received through the bit chuck 80. The bit extension 54 can also be made with the same material as the tool bit 52, that is, both with steel. The bit connector 56 alone would be used as the hinge in this case as the bit extension 54 would be made in rigid steel. One form of this hinge could be a short living hinge. The bit extension 54 and the tool bit 52 can be integrally manufactured together by overmolding the bit connector 56 over the steel manufactured version of the bit extension 54 and the tool bit 52. The bit connector 56, in this case, could be a shrink wrap type of material or an overmolded polypropylene, Nylon™, Teflon™, Vinyl™ and like plastic materials, to act as a shorter living hinge structure or pivot at the point of connection. It is apparent that there are a number of hinging mechanisms that can provide for control of the delivery orientation of each bit assembly 100, that each provides for easy deflection in a radial direction and resists deflection in a transverse direction, that such mobility and orientation control is achieved either at a single point or node (at bit connector 56) or along multiple nodes over the length of a shaft or flexural (bit extension 54 or bit extension 54 and bit connector 56)).

It can therefore be readily seen that each bit assembly 100 is adapted to be easily deflected in a radial direction with respect to the longitudinal axis of the multi-bit driver 30, and resists deflection in a transverse direction relative to the longitudinal axis, to operably align the selected tool bit 52 with the tool bit receiving channel 89 as the tool bit 52 is urged into the extended position.

Figure 11:
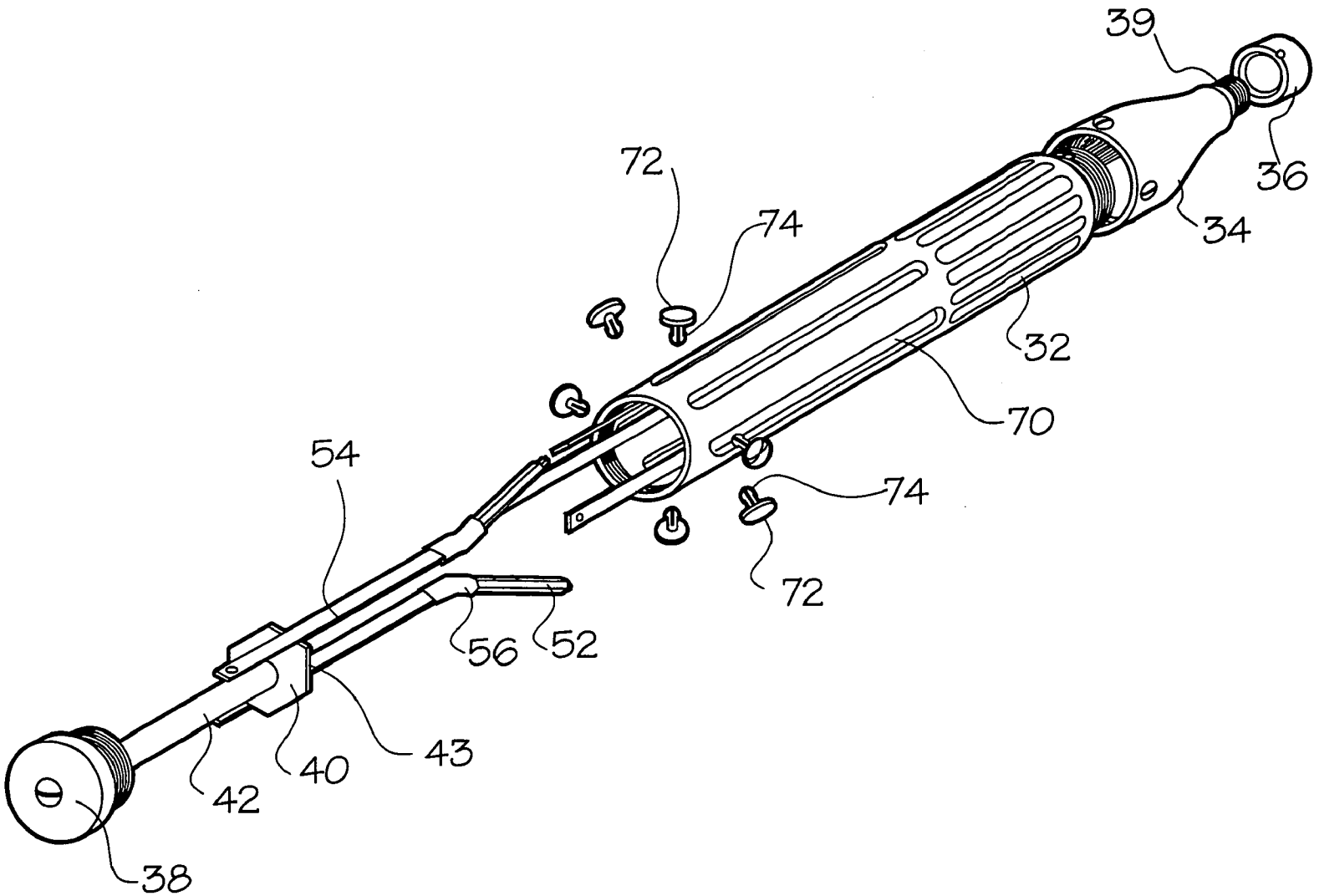
FIG. 11 is a partial exploded perspective view of the multi-bit driver.
Figure 16:
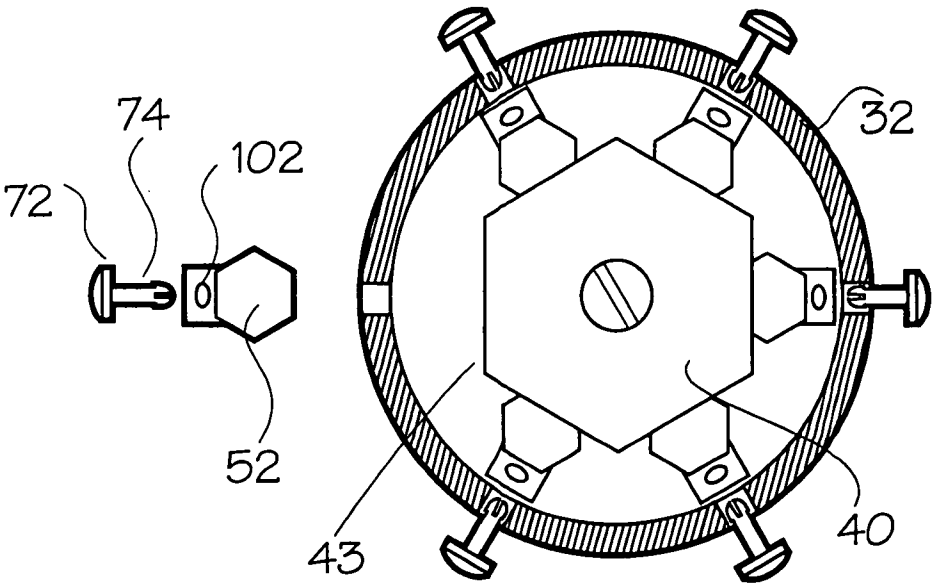
FIG. 16 is a cross-sectional view of the multi-bit driver taken along lines 16—16 of FIG. 8.
Figure 15:
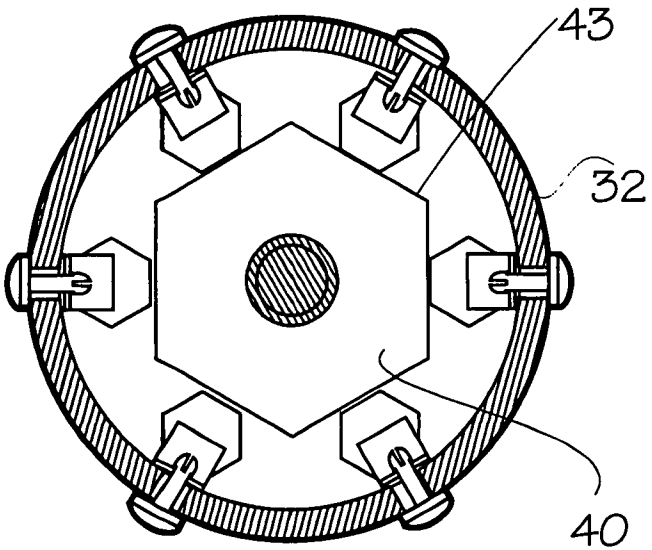
FIG. 15 is a cross-sectional view of the multi-bit driver shown in FIG. 8 taken along lines 15—15.

As best shown in FIG. 11 once bit assemblies 100 have been assembled, they are loaded into barrel 32 as shown in FIG. 11. Bit assemblies 100 are urged through cap end 60 of barrel 32 and are longitudinally aligned with an actuator channel 70 in barrel 32. In this manner, bit assemblies 100 are nested equidistant around the interior circumference of barrel 32 and in this case 6 bit assemblies are shown to be inserted into barrel 32. Note that preferably each bit assembly 100 has a slight angular bend namely angle theta 108 as shown in FIG. 13. At connector 56 where tool bit 52 is connected with bit extension 54, the angle theta is approximately 20° which has been found to work best in practise. Angle theta 108 can range from 1° to 45°, however, the preferred angle is 20°. Angle theta 108 is incorporated into bit assembly 100 in order to keep head end 112 of bit assemblies 100 proximate the inner diameter of barrel 32 and to prevent tool bit 52 from impinging on one another while loaded in barrel 32. Angle theta 108 is also required to ensure tool bit 52 is aligned longitudinally with receiving channel 89 when it enters bit chuck 80. From FIGS. 3 and 11 you will see that assemblies 100 are installed into barrel 32 such that the head end 112 of tool bits 52 are projecting outwardly toward to the interior diameter of barrel 32.

Once bit assembly 100 has been inserted far enough into barrel 32 such that fastener aperture 102 lines up with an actuator channel 70, bit assembly 100 is then slidably fastened to barrel 32 by inserting an actuator knob 72 having a knob fastener 74 which as shown is of the split collar type, in order to fasten bit assembly 100 to barrel 32. Note that bit assembly 100 is free to slidably move along actuator channel 70 by urging knob fastener 74 longitudinally upward or downward along actuator channel 70. Knob fastener 74 of actuator knob 72 passes through actuator channel 70 defined in barrel 32, as well as through fastener aperture 102 defined in bit extension 54, wherein fastener aperture 102 is dimensioned so that as fastener 74 passes through fastener aperture 102 it locks extension 54 to knob fastener 74.

Once bit assemblies 100 are in place, and fastened into place with knob fastener 74, bit guide 41 can now be inserted through cap end 60 of barrel 32. Guide 40 is connected to guide support 42 in such a manner so as to allow guide 40 to rotate independently of guide support 42 while threading end cap 38 into threads 62 at cap end 60.

With guide 40 in place, the bit extension 54 of bit assemblies 100 are in slideable engagement with guide faces 43 of guide 40 as they are urged along actuator channel 70. Guide 40 serves to maintain bit extension 54 in their proper position longitudinally aligned with actuator 70 and also ensures to keep bit assemblies 100 nested outwardly adjacent the inner diameter of barrel 32.

Figures 8, 9, 10:
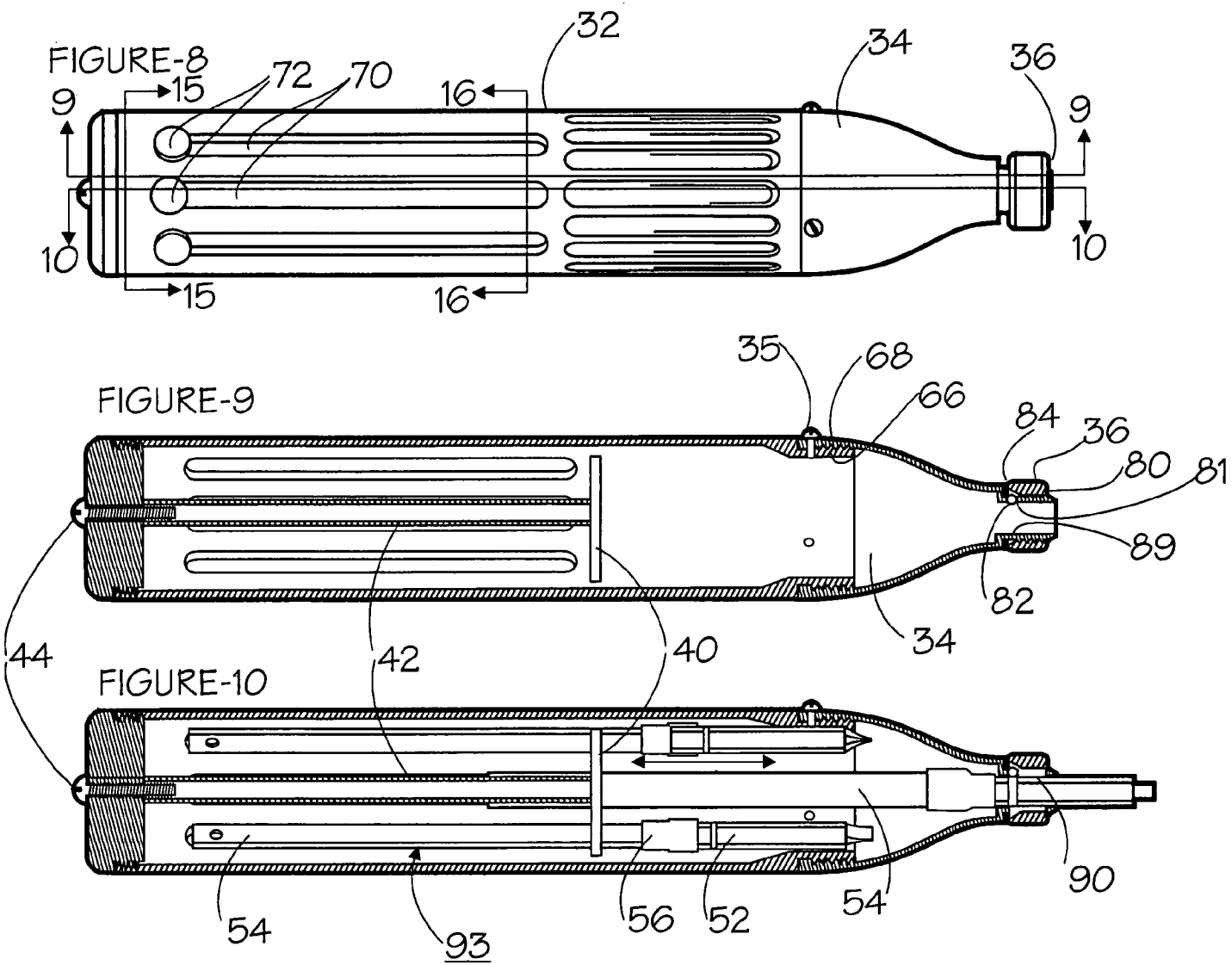
FIG. 8 is a top plan view of the multi-bit driver.
FIG. 9 is a cross-sectional view of the multi-bit driver shown in FIG. 8, taken along lines 9—9.
FIG. 10 is cross-sectional view of the multi-bit driver shown in FIG. 8, taken along lines 10—10.

As best shown in FIGS. 9 and 10, cone 34 can now be threadably installed onto external thread 66 of barrel 32 and subsequently locking screw 35 can be installed to ensure that cone 34 does not rotate or turn on external thread 66 but rather remains in a stationary position.

Once cone 34 is in place, steel ball 82 is placed into a counter sink 81 located in bit chuck 80 and collar 36 is threadably attached to chuck end 39 until tapered surface 84, makes contact with steel ball 82. This completes the assembly of multi-bit driver 30. The steel ball 82 is a locking member that is part of a locking means that also comprises the locking groove 90 in each tool bit 52, and is for locking the tool bit 52 in the extended position, as will be discussed in greater detail subsequently.

In Use

As best shown in FIGS. 10 and 14, multi-bit driver 30 is utilized as follows. With all of the six bit assemblies 100 installed into barrel 32 and nested equally around the interior circumference of barrel 32, tool bit 52 can be selected from retracted position 93 for use by slidably urging actuator knob 72 longitudinally along actuator channel 70.

As shown in FIG. 14, as actuator knob 72 is moved with simple finger pressure longitudinally along actuator channel 70 such that, head end 112 and/or driver head 104 of tool bit 52 makes contact with the interior guide surface 110 of cone 34. Tool bit 52 is guided into and enters bit receiving channel 89. As actuator knob 72 continues to be urged upwardly along actuator channel 70, tool bit 52 slidably moves along guide surface 110 thereby flexing bit extension 54 as tool bit 52 moves closer to bit receiving channel 89. Finally, tool bit 52 enters bit receiving channel and is aligned with longitudinal axis 99 of housing 31. Tool bit 52 should be substantially aligned longitudinally with housing 32 in order to be able to usefully employ multi-bit driver 30.

Tool bits 52 normally have an exterior hexagonal profile and the bit receiving channel 89 is of a cooperating hexagonal shape. The flat longitudinally aligned bit extension 54 sliding along guide faces 43 on guide 40 serve to align tool bit 52 exactly with bit receiving channel 89 such that tool bit 52 is easily and slidably received within bit receiving channel 89 anytime it is urged towards bit receiving channel 89.

By continuing to urge knob fastener 74 upwardly, tool bit 52 passes through bit receiving channel 89 until locking groove 90 aligns with steel ball 82 located in counter sink 81 in bit chuck 80. At this point tool bit 52 is aligned with longitudinal axis 99, and is in the extended position 97.

In order for tool bit 52 to slidably and easily pass through receiving channel 89, collar 36 is eased off and/or threadably moved forward along bit chuck 80, such that tapered surface 84 does not contact steel ball 82 and is free to move upwardly within countersink 81.

As discussed above, the locking means is for locking the tool bit 52 in the extended position, and comprises the steel ball 82 and, the locking groove 90.

Once locking groove 90 aligns with steel ball 82, collar 36 is threadably engaged and rotated onto bit chuck 80 until tapered surface 84 of collar 36 engages with steel ball 82 forcing it downwardly into countersink 81 so that steel ball 82 makes contact with locking groove 90, thereby locking tool bit 52 rigidly and securely into bit receiving channel 89. In this manner, the steel ball 82 is selectively movable into contact with the locking groove 90.

At this point, tool bit 52 is ready to be used and driver head 104 can be pushed and urged against any fastener head in the traditional manner.

To select another tool bit 52, collar 36 is threadably eased away from steel ball 82, thereby allowing steel ball 82 to move upwardly within countersink 81, thereby releasing steel ball 82 from locking groove 90 and tool bit 52. Actuator knob 72 is urged backwardly along actuator channel 70 retracting tool bit 52 back into barrel 32 of housing 31.

Subsequently another tool bit 52 can be selected in the same manner described above and urged forwardly up actuator channel 70 to be put into the working position in bit receiving channel 89 as described here above.

DESCRIPTION OF THE ALTERNATIVE EMBODIMENT

Referring now to FIGS. 17 through 24 which depict the presently preferred embodiment namely, multi-bit driver 230, the concept of multi-bit driver 230 is analogous to the concept of multi-bit screw driver 30 with some modifications as will be described here below.

Figure 17:
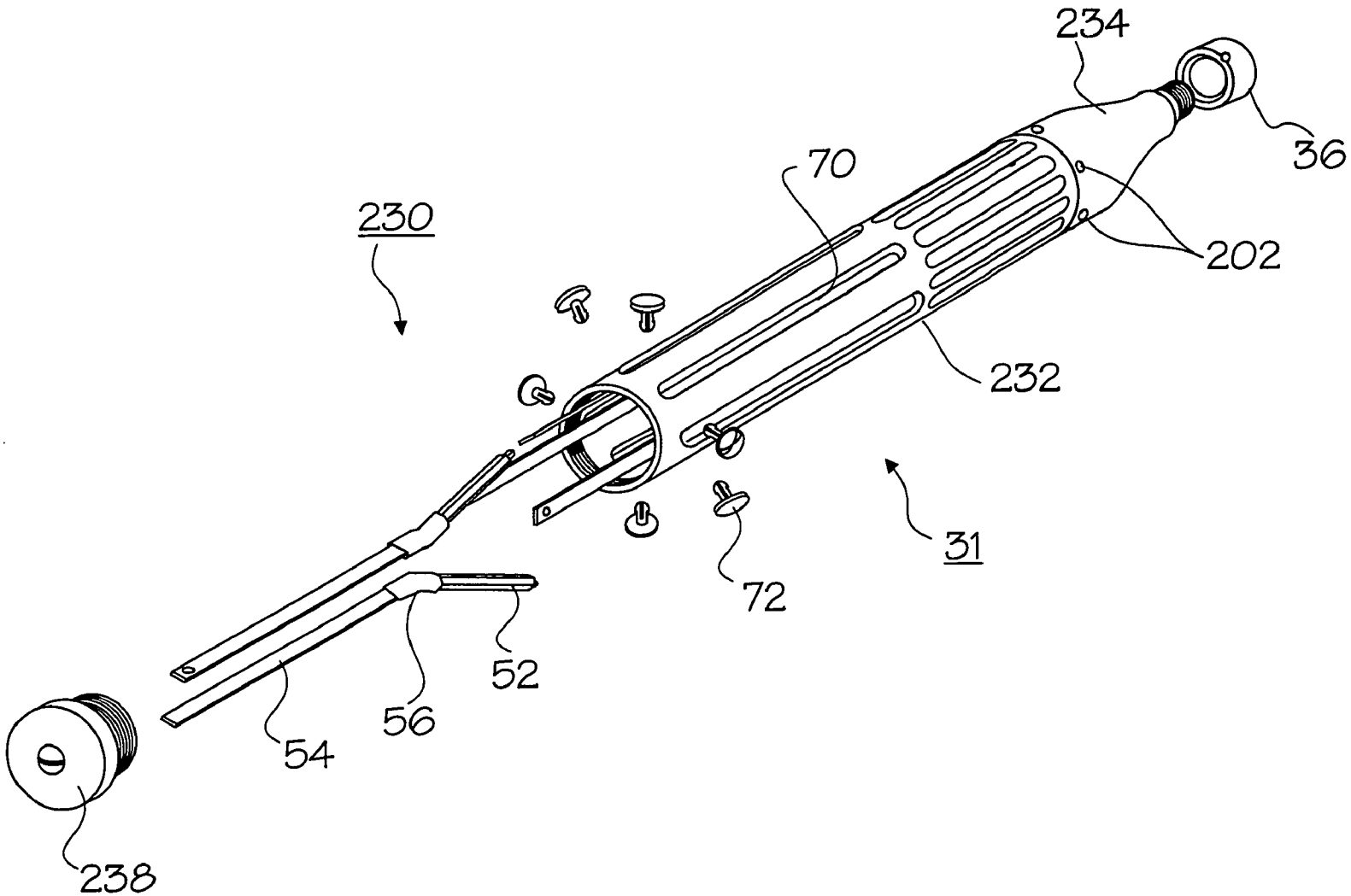
FIG. 17 is a partial exploded perspective schematic view of an alternate embodiment of the multi-bit driver.

Referring first of all to FIG. 17, multi-bit driver 230 includes the following major components, namely barrel 232, cone 234 having collar 36, actuator knob 72, end cap 238 and bit assemblies 100 including bit extension 54, connector 56 and tool bit 52. Note that this presently preferred embodiment, namely multi-bit driver 230 has eliminated the bit guide 41, comprising of guide 40 and guide support 42. Bit guide 41 functions to maintain bit assemblies 100 nested circumferentially equally around the inner portion of barrel 32 and to keep the bit assemblies 100 nicely separated within barrel 32. Bit guide 41 has essentially been replaced with magnets 202 which are located as shown in the FIGS. 17–24.

Figure 18:
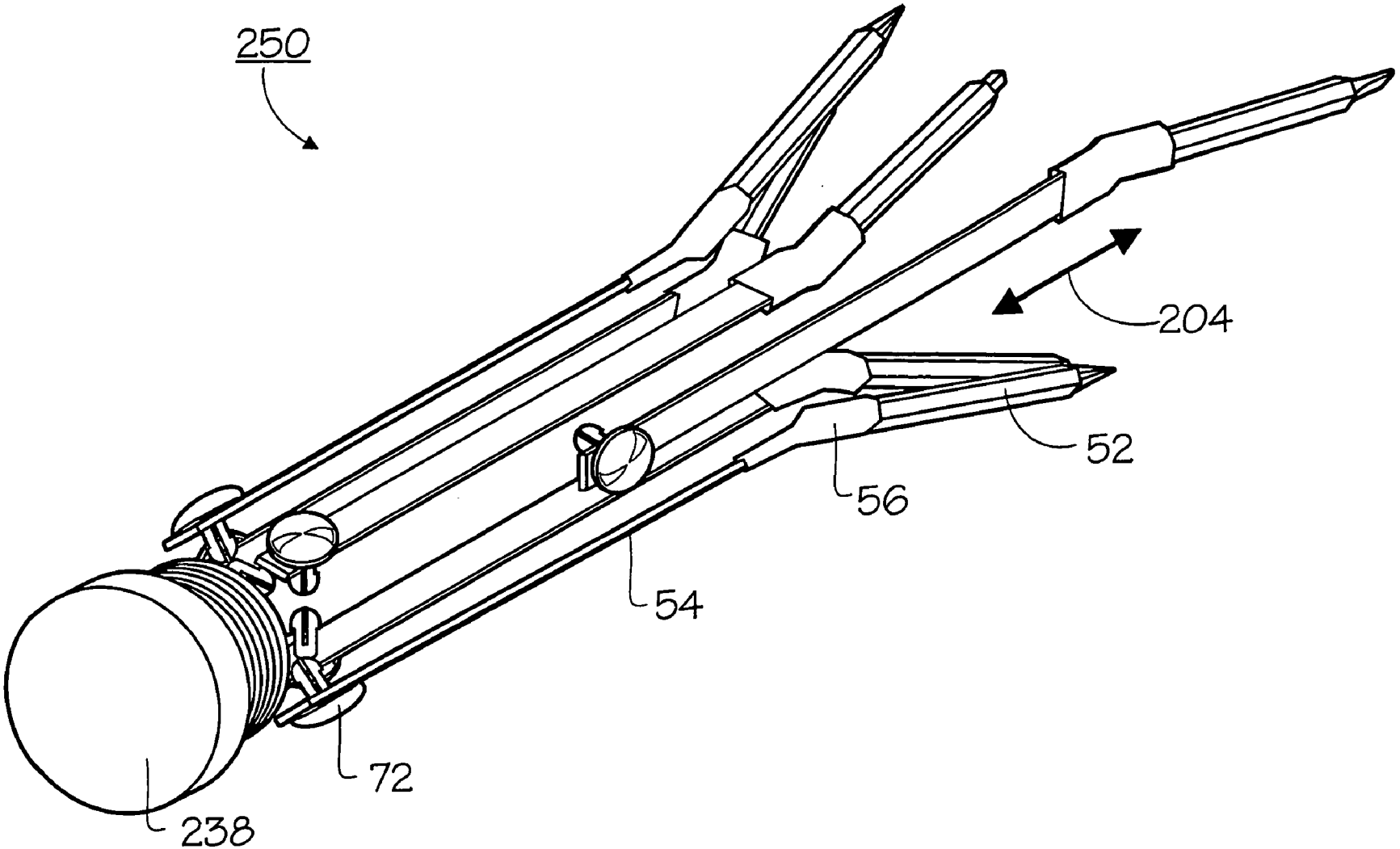
FIG. 18 is a perspective schematic view of the presently preferred embodiment of the bit cartridge of FIG. 17.

Referring to FIG. 18, one will see that the presently preferred bit cartridge 250 includes end cap 238, actuator knob 72, bit extension 54, connector 56, tool bit 52 and has eliminated bit guide 41 which is comprised of guide 40 and guide support 42.

Figure 19:
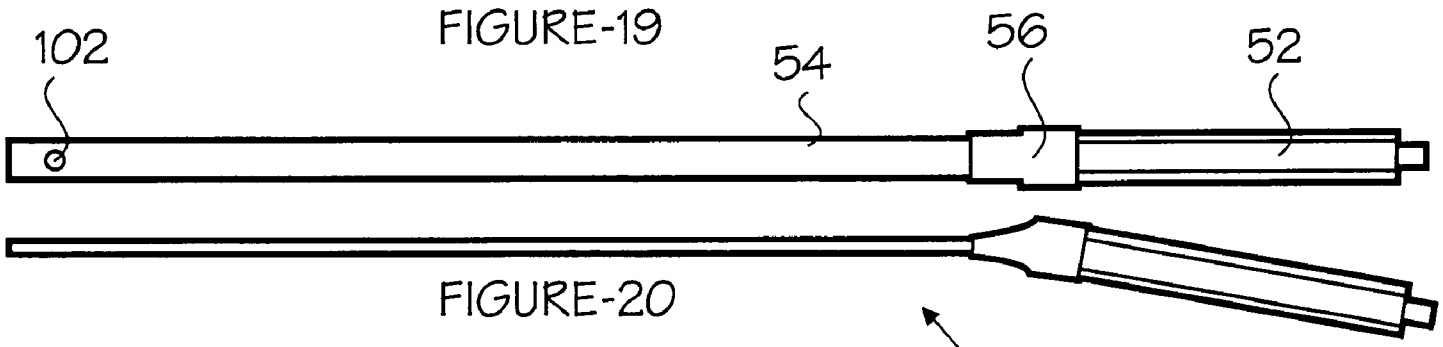
FIG. 19 is a top plan view of the bit assembly of the presently preferred embodiment.
Figure 20:
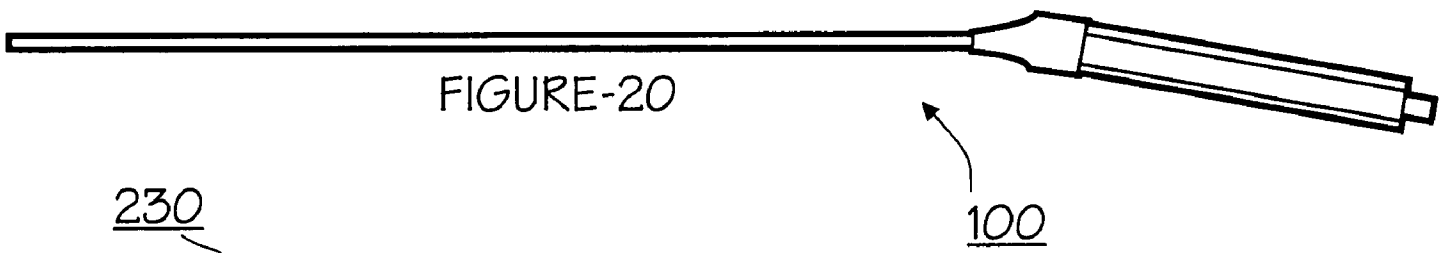
FIG. 20 is a side plan view of the bit assembly of the presently preferred embodiment.

Referring now to FIGS. 19 and 20 which illustrate bit assembly 100 which remains essentially unchanged being comprised of bit extension 54, connector 56 and tool bit 52 and having a fastener aperture 102 in one end of bit extension 54.

Figure 21:
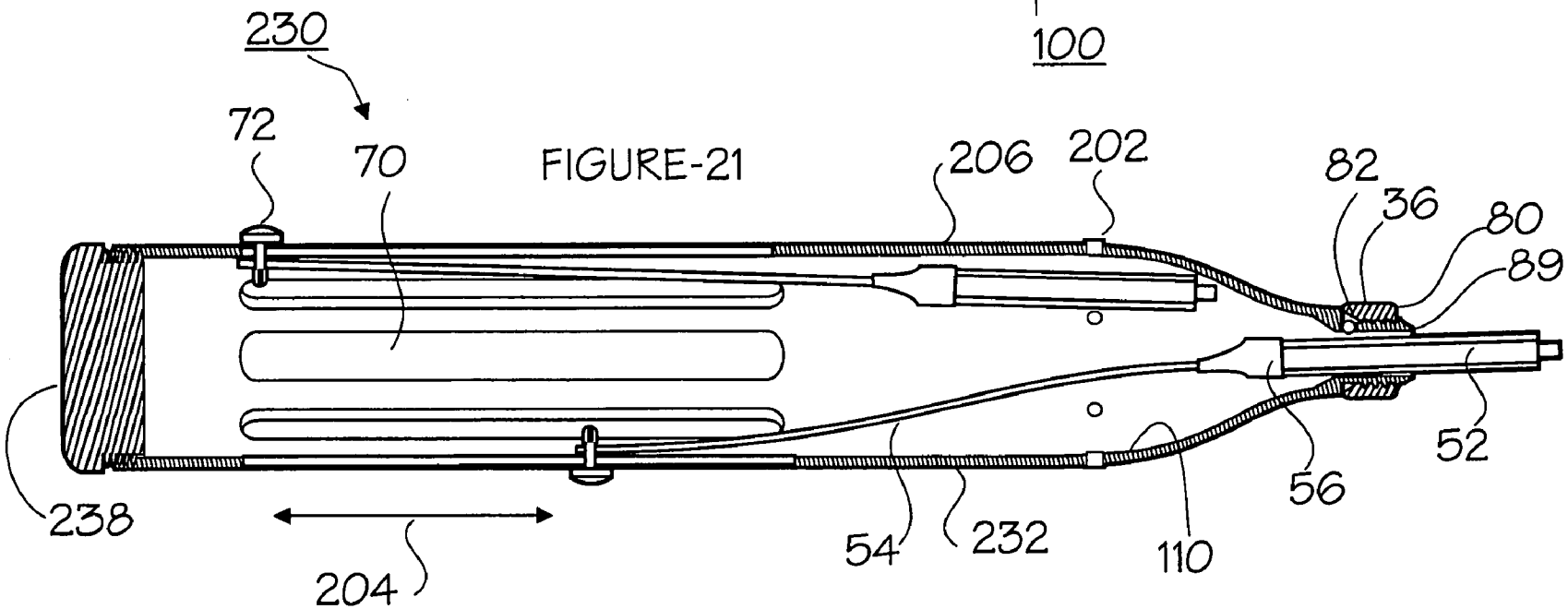
FIG. 21 is a partial cut away view of the presently preferred embodiment multi-bit driver showing the relationship of the bit assemblies and the barrel of FIG. 17.

Referring now to FIG. 21, showing schematically the bit assemblies 100 located within barrel 232, I will now explain the difference in operation between the current multi-bit driver 230 and the previous multi-bit screw driver 30.

Referring now to FIG. 21, bit assembly 100 is urged along longitudinal direction 204 by applying finger pressure to actuator knob 72 which is operatively connected to the fastener aperture 102 of bit extension 54. As actuator knob 72 is urged along actuator channel 70, it in turn urges tool bit 52 longitudinally along the inside of barrel 232 until tool bit 52 exits out of bit chuck 80 of barrel 232. One skilled in the art will notice that bit extensions 54 are flexible in one direction and therefore, conforms to forces in that direction imparted upon bit extension 54. Bit assembly 100 is kept nested along barrel wall 206 by the attraction forces between magnets 202 and metallic tool bit 52 as it is being extended and retracted out of barrel 232. Magnets 202 preferably are of the permanent magnet type. Looking to FIG. 21 for example, the upper bit assembly 100 is nested closely to barrel wall 206 because of the attraction between tool bit 52 of bit assembly 100 and magnet 202. In this manner as the bit assemblies are extended and retracted out of barrel 232, they are kept separate and apart and kept from interfering with each other because of the attraction caused by magnet 202 with each individual tool bit 52. There is an individual magnet 202 for each individual tool bit 52 being placed in barrel 232. As discussed above, preferably there are six tool bits 52, meaning 6 bit assemblies 100 nested around the inner diameter of barrel 232 which must be kept separate and apart and prevented from interfering with each other as they are being extended and retracted. In every other manner, multi-bit driver 230 operates in the same manner as multi-bit screw driver 30 does as described above. The major differences being that the bit guide 41 is no longer present, namely former parts guide 40 and guide support 42 are no longer necessary and have been replaced by magnets 202.

Figure 22:
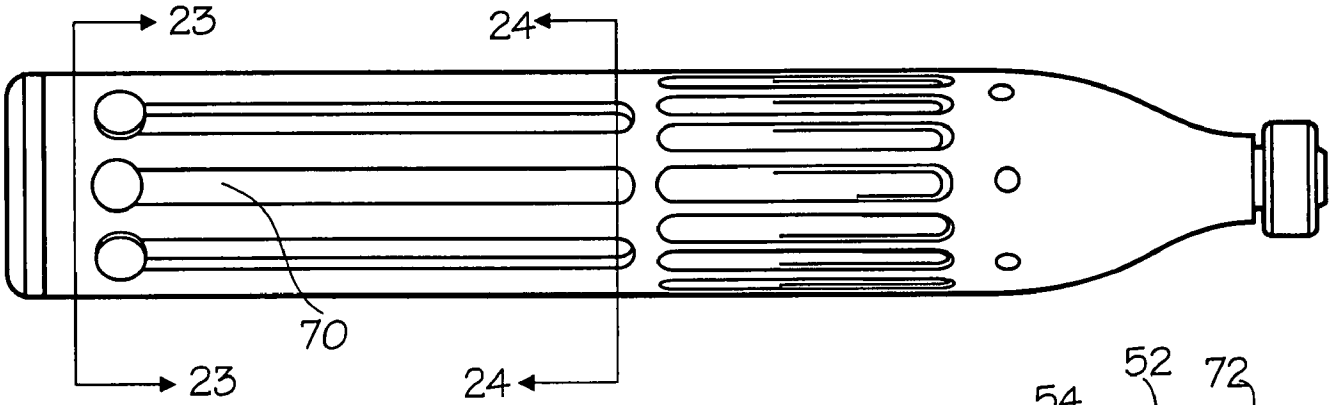
FIG. 22 is a top plan view of the presently preferred embodiment of the multi-bit driver of FIG. 17.
Figure 24:
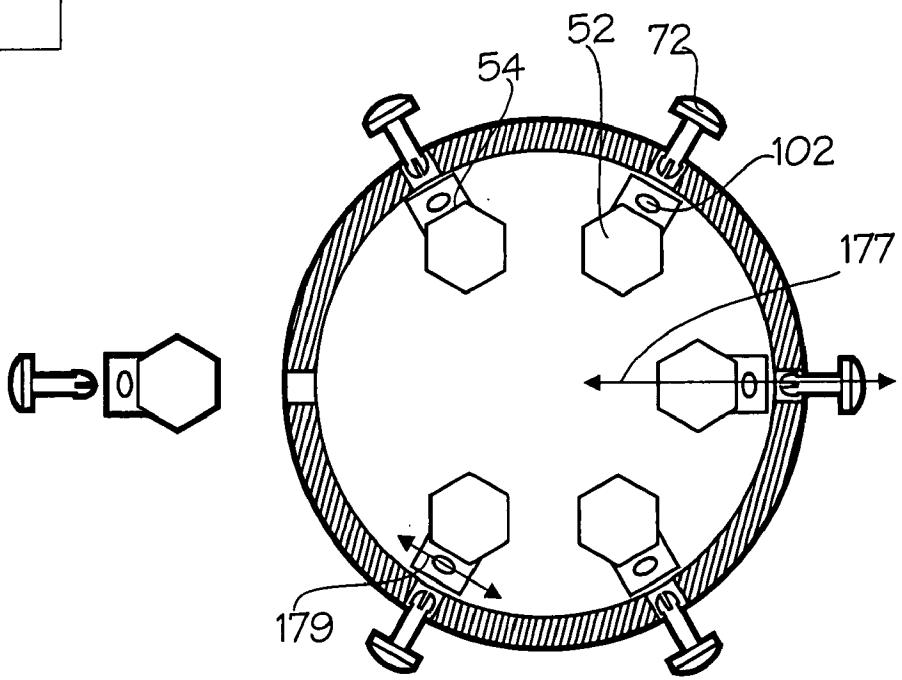
FIG. 24 is a cross sectional view of the presently preferred multi-bit driver shown in FIG. 22, taken along lines 24—24.
Figure 23:
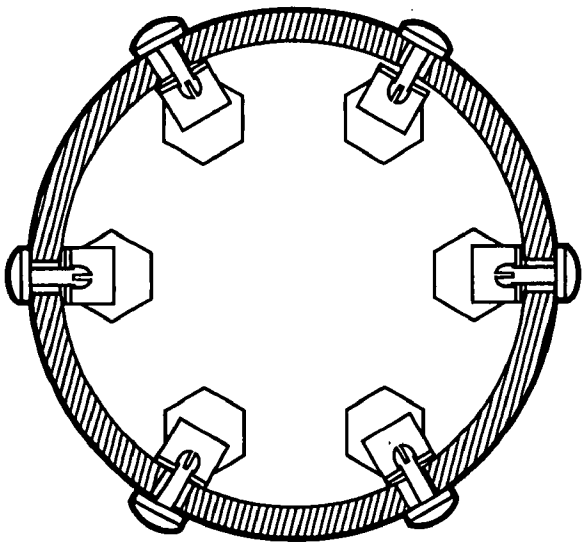
FIG. 23 is a cross sectional view of the presently preferred multi-bit driver shown in FIG. 22 taken along lines 23—23.

Referring now to FIGS. 23 and 24 which are cross-sectional view taken along 23—23 of FIG. 22 and 24—24 of FIG. 22 respectively, one will see that the bit guide 41 components, namely guide 40 and guide support 42, are no longer present within the interior of barrel 232 as in the previous embodiment, namely multi-bit screw driver 30. Bit extension 54 is flexible in radial direction 177 and stiffer in lateral direction 179.

Furthermore, it will be understood by persons skilled in the art that bit assembly 100 as shown comprised of three major components, namely bit extension 54, connector 56 and tool bit 52, may in fact be manufactured from one single integral piece. For example, bit assembly 100 may be made of one continuous metal component having a flexible end corresponding to bit extension 54 which is flattened and has spring like qualities and not requiring any kind of a connector 56 in that the bit extension 54 and the tool bit 52 are integrally made of one component. In addition, there are any number of other combinations that are possible to produce bit assembly 100, the important factor being that the bit extension 54 section being flexible in nature in order that it can move along the interior portion of cone 34 as the bit assembly 100 is urged longitudinally along longitudinal direction 204.

Preferably, bit assembly 100 is flexible in the radial direction and not flexible in the lateral direction to prevent interference of the bit assemblies with each other within barrel 232. Therefore, the preferred flat cross sectional shape of bit extension 54 as shown in the Figures.

As can be readily discerned from the above disclosure, the multi-bit driver 30 overcomes the disadvantages of the known prior art, due to the fact that the bit extension 54 is adapted to be easily deflected in a radial direction with respect to the longitudinal axis of the housing and resists deflection in a transverse direction relative thereto. Accordingly, the selected tool bit 52 is properly aligned, both angularly and rotationally, with the hexagonal tool bit receiving channel 89 upon movement to the extended position. Also because of the limited motion in the transverse direction, the chances of tangling between the tool bit 52 that is being engaged between other tool bits 52 is dramatically reduced.

Bit assembly 100 must be flexible enough to allow tool bit 52 to move along the inner surface of cone 234 and/or cone 34 in order that tool bit 52 would enter into receiving channel 89 of bit chuck 80 of cone 234 or 34. The bit extension 54 of bit assembly 100 must, however be stiff enough to urge the tool bit 52 through the receiving channel 89.

It should be apparent to persons skilled in the arts that various modifications and adaptations of this structure described above are possible without departure from the spirit of the invention the scope of which defined in the appended claim.

I claim:

1. A multi-bit driver comprising:

a longitudinal housing including a bit chuck having a tool bit receiving channel, and plurality of actuator channels, and defining a longitudinal axis;

a plurality of tool bits nested within said housing in a retracted position;

actuating means for selectively extending said tool bits from said retracted position to an extended position whereat the selected tool bit projects from said tool bit receiving channel, and retracting the selected tool bit from said extended position to said retracted position;

wherein said bit chuck precludes said tool bit from rotating axially when in said extended position; and, locking means for locking said tool bit in said extended position;

wherein each said actuating means is adapted to be easily deflected in a radial direction with respect to said longitudinal axis and resists deflection in a transverse direction relative thereto, to operably align the selected tool bit with said tool bit receiving channel as said tool bit is urged into said extended position.

2. The multi-bit driver claimed in claim 1, wherein each said actuating means is flexible.

3. The multi-bit driver claimed in claim 1, wherein each said actuating means includes a bit extension operably connected at one end to one of said tool bits and at the other end operably slideably connected to said housing, such that said bit extension is guided slidably along said actuator channel.

4. The multi-bit driver claimed in claim 1, wherein said locking means comprises a locking groove in each said tool bit and a locking member selectively movable into contact with said locking groove.

5. The multi-bit driver claimed in claim 1, further comprising fastening means connected to said bit extension for slidably connecting said bit extension to said housing.

6. The multi-bit driver claimed in claim 1, wherein said bit extension has a planar profile with a width greater than its thickness.

7. The multi-bit driver claimed in claim 1, wherein said bit extension has a thickness to width ratio of at least 1:1.5.

8. The multi-bit driver claimed in claim 7, wherein said bit extension has a thickness to width ratio of at least 1:3.0.

9. The multi-bit driver claimed in claim 1, wherein said actuating means operates to extend said tool bit by longitudinal motion in one direction and retract said tool bit by longitudinal motion in the opposite direction.

10. The multi-bit driver claimed in claim 1, wherein said actuating means comprises an actuator knob partially projecting externally of said housing for the application of finger pressure thereto.

11. The multi-bit driver claimed in claim 1, wherein said housing includes a cone proximate said bit chuck, said cone having an interior guide surface for slidably guiding tool bits into alignment with said bit chuck as tool bits are urged into said extended position.

12. The multi-bit driver claimed in claim 11, wherein said cone is disposed between said retracted tool bits and said bit chuck for guiding tool bits into alignment with said bit chuck as tool bits are urged into said extended position.

13. The multi-bit driver claimed in claim 12, wherein said cone is an integral part of said housing.

14. The multi-bit driver claimed in claim 1, wherein said guide means further comprises a guide support connected at one end to said guide and at an opposite other end to an end cap.

* * * * *